US006638021B2

(12) United States Patent
Olhofer et al.

(10) Patent No.: US 6,638,021 B2
(45) Date of Patent: Oct. 28, 2003

(54) TURBINE BLADE AIRFOIL, TURBINE BLADE AND TURBINE BLADE CASCADE FOR AXIAL-FLOW TURBINE

(75) Inventors: Markus Olhofer, Seligenstadt (DE); Bernhard Sendhoff, Obertshausen (DE); Satoshi Kawarada, Saitama (JP); Toyotaka Sonoda, Saitama (JP); Toshiyuki Arima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,177

(22) Filed: Nov. 1, 2001

(65) Prior Publication Data

US 2002/0085918 A1 Jul. 4, 2002

(30) Foreign Application Priority Data

Nov. 2, 2000 (DE) ..... 100 54 244

(51) Int. Cl.[7] ..... F01D 5/14
(52) U.S. Cl. ..... 416/242; 416/243; 416/223 A
(58) Field of Search ..... 416/242, 243, 416/DIG. 2, DIG. 5, 223 A

(56) References Cited

U.S. PATENT DOCUMENTS

| | | | | |
|---|---|---|---|---|
| 4,080,102 A | | 3/1978 | Schwabe | |
| 4,531,890 A | * | 7/1985 | Stokes | 416/187 |
| 5,352,092 A | * | 10/1994 | Ferleger et al. | 416/223 A |
| 6,116,856 A | * | 9/2000 | Karadgy et al. | 416/203 |

FOREIGN PATENT DOCUMENTS

| | | |
|---|---|---|
| DE | 25 24 250 | 5/1975 |
| GB | 2106192 A * | 4/1983 |

OTHER PUBLICATIONS

Calculus with Analytical Geometry, Robert Ellis and Denny Gulick, 1982, Harcourt Brace Jovanovich, Inc., Second edition, pp. 204–205.*

"Uber den Einfluβ der Machzahl und der Reynoldszahl auf die Aerodynamischen Beiwerte von Verdichter–Schaufelgittern bei Verschiedener Turbulenz der Strömung", HEBBEL, *Forsch. Ing.–Wes*, vol. 33, (1967), No. 5, pp. 141–150. Translated Copy of the Above Paper.

* cited by examiner

*Primary Examiner*—Ninh H. Nguyen
(74) *Attorney, Agent, or Firm*—Arent Fox Kintner Plotkin & Kahn, PLLC

(57) ABSTRACT

A turbine blade for an axial-flow turbine includes an intrados generating a positive pressure, and an extrados generating a negative pressure, wherein the intrados and the extrados are provided between a leading edge and a trailing edge. An inflection point is provided between a concave portion on an upstream side and a convex portion on a downstream side in a region extending from a position of 80% on the intrados to a rear throat, and the length of a normal line drawn downwards from the intrados of one of the turbine blades to an extrados of the other turbine blade has at least one maximum value in a region extending from a front throat of the one turbine blade to a rear throat. Thus, it is possible to disperse a shock wave generated from the intrados at the trailing edge to prevent the generation of a strong shock wave, thereby reducing the pressure loss caused by the shock wave. In addition, a speed-reducing area can be formed on the extrados generating the negative pressure to promote the transition from a laminar flow boundary layer to a turbulent flow boundary layer, thereby preventing the separation of the boundary layer caused by the interference with a shock wave to reduce the pressure loss.

4 Claims, 6 Drawing Sheets

TURBINE BLADE AIRFOIL, TURBINE BLADE AND TURBINE BLADE CASCADE FOR AXIAL-FLOW TURBINE

BACKGROUND OF THE INVENTION

1. Field of the Invention

The present invention relates to a turbine blade airfoil for an axial-flow turbine including an intrados generating a positive pressure and an extrados generating a negative pressure, the intrados and the extrados being provided between a leading edge and a trailing edge, a turbine blade to which such turbine airfoil is applied, and a turbine blade cascade comprising an assembly of such turbine blades.

2. Description of the Prior Art

A turbine blade S and blade cascade of a conventional axial-flow turbine are shown by a dashed line in FIG. 1. The airfoil of the turbine blade S includes a leading edge LE, a trailing edge TE, an extrados Su extending from the leading edge LE to the trailing edge TE and generating mainly a negative pressure during operation of the turbine, and an intrados S1 extending from the leading edge LE to the trailing edge TE and generating mainly a positive pressure during operation of the turbine. A portion of the intrados Sl near the trailing edge TE assumes a simple concave shape having no inflection point, and the blade—blade distance D in the blade cascade of adjacent turbine blades S, namely, the length of a normal line drawn downwards from the intrados Sl of one of the turbine blades S to the extrados Su of the other turbine blade S is decreased monotonously in a region extending from a front throat to a rear throat.

There are conventionally known inventions relating to the shape of a trailing edge portion of a turbine blade, which have been described in Japanese Patent Application Laid-open Nos.57-113906, 7-332007 and 9-125904.

The turbine blade described in Japanese Patent Application Laid-open No.57-113906 has a construction in which a trailing edge is curved toward an extrados, or a construction in which the curvature of the extrados at the trailing edge is larger than that of an intrados. This construction ensures that the generation of a shock wave at a transonic speed is controlled to alleviate the load applied to the turbine blade and to reduce the pressure loss.

The turbine blade described in Japanese Patent Application Laid-open No.7-332007 has a corrugated unevenness at a trailing edge. This construction ensures that the distribution of flow in the radial direction of a turbine is liable to be interfered, and the proportion of speed loss due to a wake is reduced to enhance the flowing performance at each stage of the turbine.

In the turbine blade of a vapor turbine described in Japanese Patent Application Laid-open No.9-125904, a portion of an extrados at a trailing edge is cut out rectilinearly. This construction ensures that the pressure loss is reduced, while ensuring a resistance to erosion caused by the vibration applied by a vapor flow or by foreign matters within the vapor flow.

The blade S (see the broken line) of the conventional axial-flow turbine shown in FIG. 1 exhibits a sufficient performance in a state in which the flow speed along a surface of the blade is a high subsonic speed and there is no shock wave generated. However, this blade S suffers from a problem that if the flow speed at the trailing edge reaches a sonic speed, shock waves SW1 and SW2 generated from the intrados Sl and the extrados Su at the trailing edge cause a reduction in performance. Particularly, one SW1 of these shock waves interferes with a boundary layer on the extrados Su of the adjacent turbine blade S to cause a pressure loss, thereby making it difficult to enhance the performance of the entire turbine.

SUMMARY OF THE INVENTION

The present invention has been accomplished with the above circumstance in view, and it is an object of the present invention to minimize the influence of a shock wave generated from the intrados at the trailing edge of the turbine blade for the axial-flow turbine to enhance the performance of the turbine.

To achieve the above object, according to a first feature of the present invention, there is provided a turbine blade airfoil for an axial-flow turbine including an intrados generating a positive pressure, and an extrados generating a negative pressure, the intrados and the extrados being provided between a leading edge and a trailing edge, characterized in that when the position along the intrados (S1) is represented by percentage such that the position of the leading edge is represented by 0%, and the position of the trailing edge is represented by 100%, an inflection point is provided between a concave portion on an upstream side and a convex portion on a downstream side in a region extending from a position of 80% on the intrados to a rear throat.

With the above arrangement, the inflection point is provided between the concave portion on the upstream side and the convex portion on the downstream side in the region extending from the position of 80% on the intrados to the rear throat. Therefore, it is possible to disperse a shock wave generated from the intrados at the trailing edge to prevent the generation of a strong shock wave, thereby reducing the pressure loss caused by the shock wave.

According to a second feature of the present invention, there is provided a turbine blade for an axial-flow turbine, which turbine blade is obtained by applying the turbine blade airfoil according to the first feature to at least a portion of the turbine blade in a span direction.

With this arrangement, it is possible to enhance the degree of freedom of the design of the turbine blade by using the turbine blade airfoil according to the present invention and an existing turbine blade airfoil in combination as desired.

According to a third feature of the present invention, there is provided a turbine blade cascade comprising an assembly of turbine blades having the turbine blade airfoil according to claim 1, characterized in that the length of a normal line drawn downwards from an intrados of one of a pair of adjacent turbine blades to an extrados of the other turbine blade has at least one maximum value in a region extending from a front throat to a rear throat of the one turbine blade.

With the above arrangement, the length of the normal line drawn downwards from the intrados of one of the pair of adjacent turbine blades to the extrados of the other turbine blade has at least one maximum value in the region extending from the front throat of the one turbine blade to the rear throat. Therefore, a speed-reducing area can be formed on the extrados generating the negative pressure to promote the transition from a laminar flow boundary layer to a turbulent flow boundary layer, thereby preventing the seperation of the boundary layer caused by the interference with a shock wave to reduce the pressure loss.

According to a fourth feature of the present invention, in addition to the third feature, there is provided a turbine blade cascade for an axial-flow turbine characterized in that the maximum value is equal to or smaller than 110% of the length of the normal line at the front throat.

With the above arrangement, the maximum value of the length of the normal line drawn downwards from the intrados of the one turbine blade to the extrados of the other turbine blade is equal to or smaller than 110% of the length of the normal line at the front throat. Therefore, a smooth transition from a laminar flow boundary layer to a turbulent flow boundary layer can be achieved.

DETAILED DESCRIPTION OF THE PREFERRED EMBODIMENT

The mode for carrying out the present invention will now be described by way of an embodiment of the present invention shown in the accompanying drawings.

Figure 1:
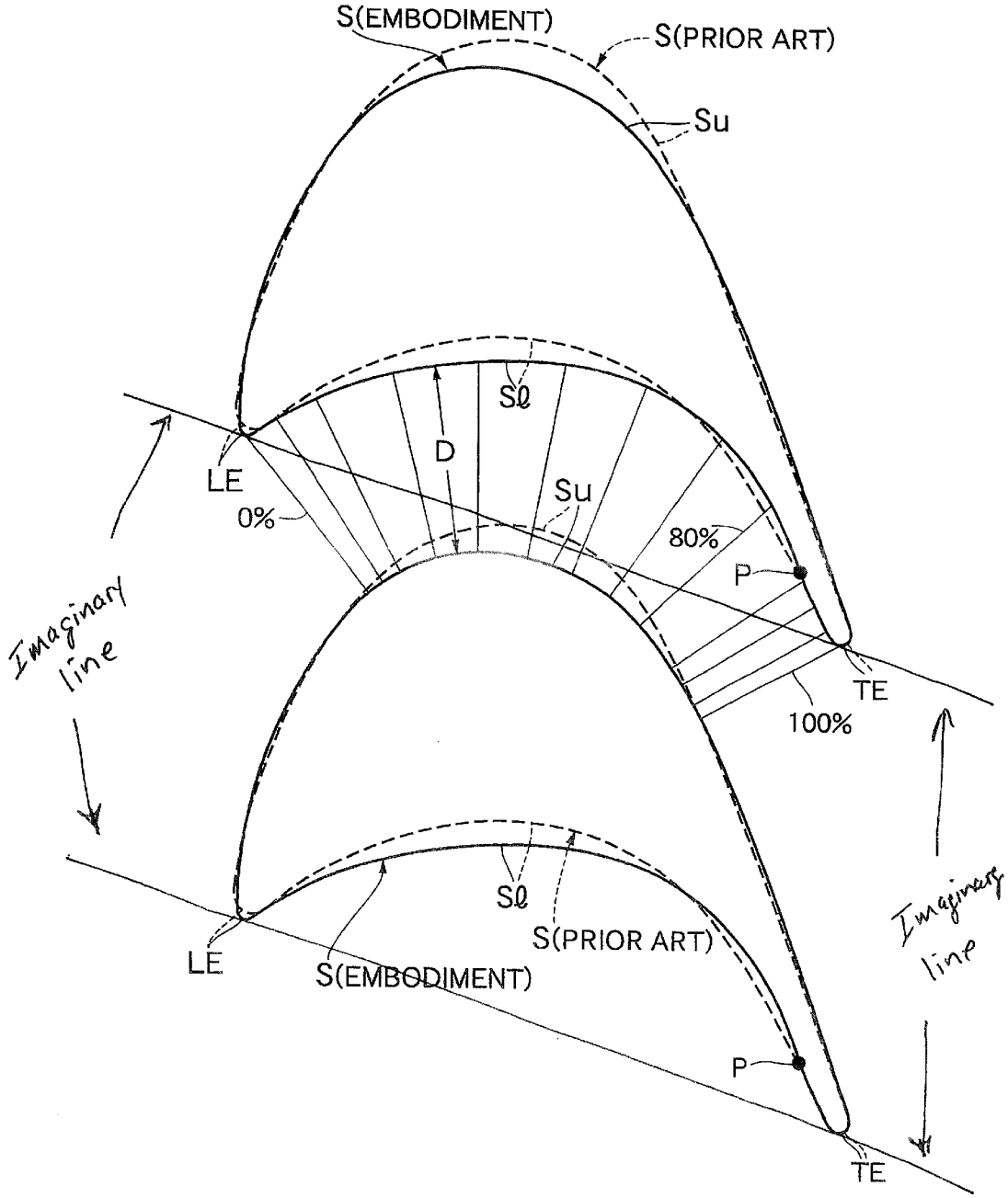
FIG. 1 is a diagram showing a turbine blade airfoil and a turbine blade cascade for an axial-flow turbine.
Figure 2:
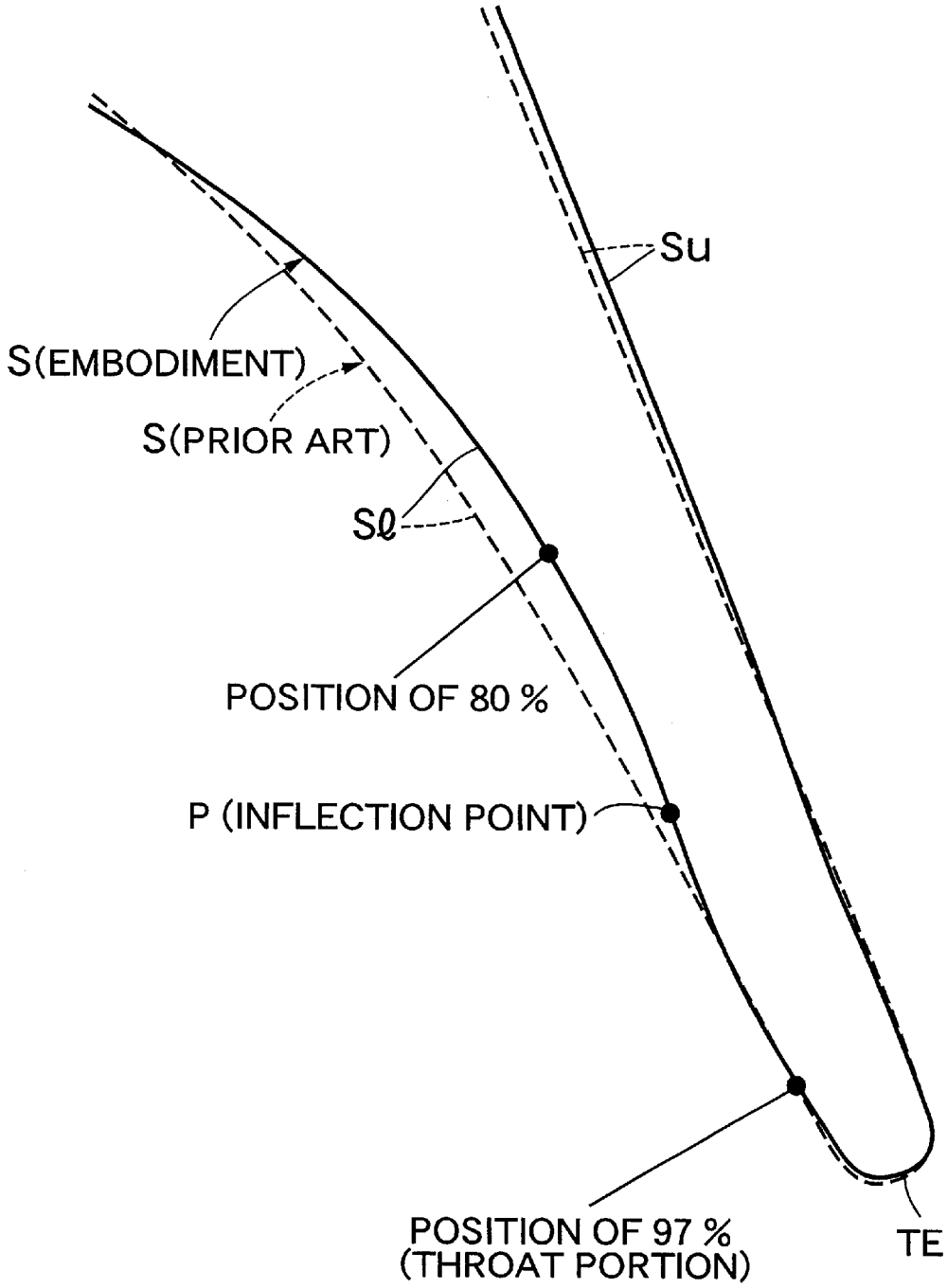
FIG. 2 is an enlarged diagram of an essential portion shown in FIG. 1.
Figure 3:
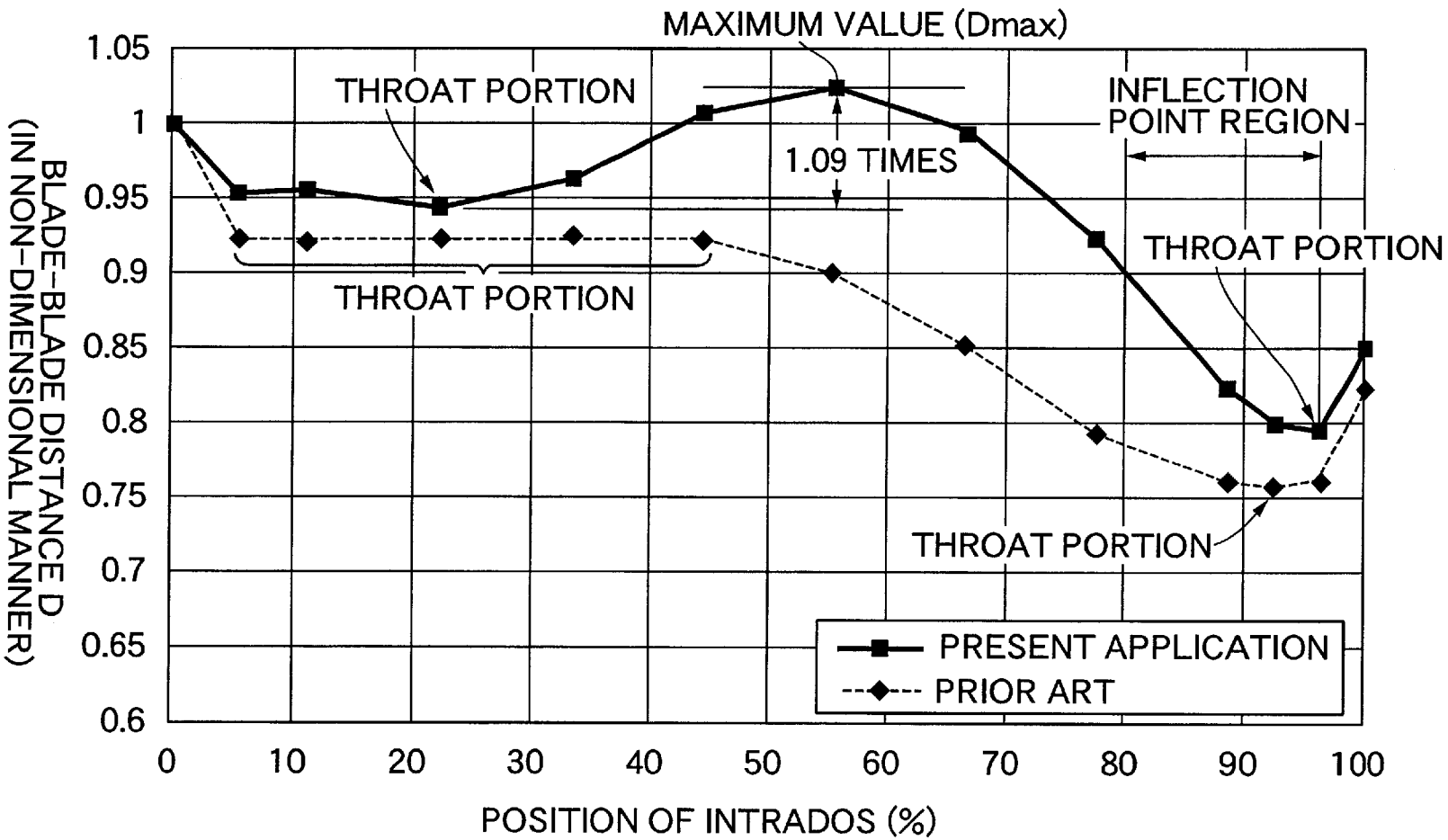
FIG. 3 is a graph showing a variation in blade—blade distance along an intrados of the blade airfoil.
Figure 4:
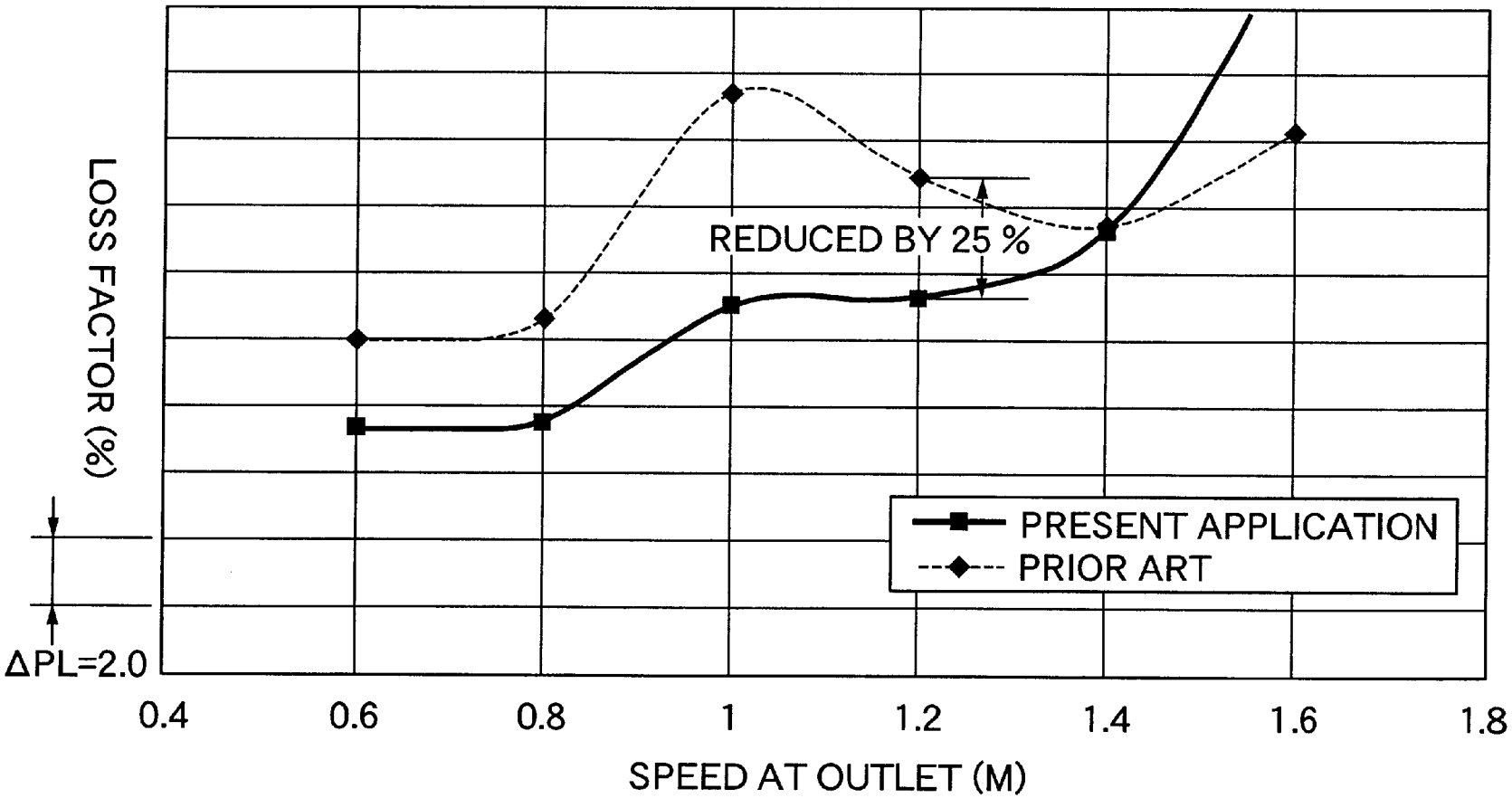
FIG. 4 is a graph showing a variation in loss factor relative to the speed at an outlet of the blade cascade.
Figure 5:
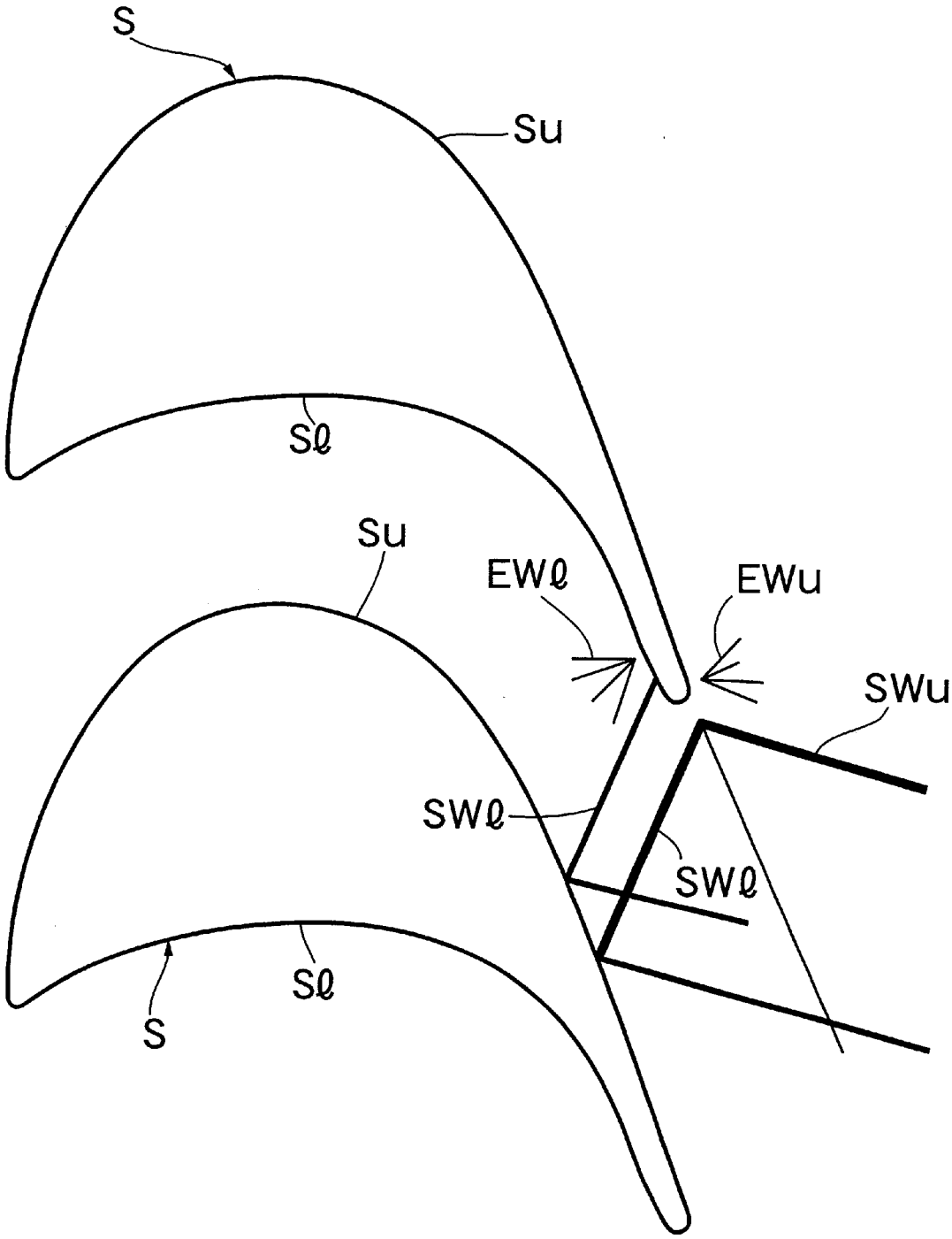
FIG. 5 is a diagram showing the state of a flow around the blade cascade in an embodiment of the present invention.

FIGS. 1 to 5 show an embodiment of the present invention, wherein FIG. 1 is a diagram showing a turbine blade airfoil and a turbine blade cascade for an axial-flow turbine; FIG. 2 is an enlarged diagram of an essential portion shown in FIG. 1; FIG. 3 is a graph showing a variation in blade—blade distance along an intrados of the blade airfoil; FIG. 4 is a graph showing a variation in loss factor relative to the speed at an outlet of the blade cascade; and FIG. 5 is a diagram showing the state of a flow around the blade cascade.

Turbine blades S shown by a solid line in FIG. 1 are disposed in an annular gas passage in an axial-flow turbine to constitute a turbine blade cascade. The turbine blade S includes an intrados S1 (a positive-pressure surface) generating a positive pressure with flowing of a gas, and an extrados Su (a negative-pressure surface) generating a negative pressure with the gas flow. A broken line in FIG. 1 shows a conventional turbine blade S shown for the comparison. As can be seen from the comparison of the turbine blade of the present embodiment and the conventional turbine blade with each other, the conventional turbine blade S shown by the broken line has no inflection point curved into a concave shape in the entire region of the intrados Sl excluding a leading edge LE and a trailing edge TE of the turbine blade S, whereas the turbine blade S of the present embodiment shown by the solid line has an inflection point P (see FIG. 2) between a portion curved into a concave shape on the side of a leading edge LE in the vicinity of a trailing edge TE and a portion curved into a convex shape on the side of the trailing edge TE.

A coordinate position on the lower surface Sl of the turbine blade S is represented by a percentage of the length along the lower surface Sl, when the leading edge LE is defined as a position of 0%, and the trailing edge is defined as a position of 100%.

Front and rear throats are defined in an inlet and an outlet between a pair of adjacent turbines S and each have a minimum sectional area of a flow path (namely, a minimum distance between the pair of turbine blades S). When a normal line is drawn downwards from the intrados Sl of one of the blade airfoils S to the extrados Su of the other blade airfoil S, the distance between the pair of the adjacent turbine blades S is equal to a length D of the normal line. FIG. 3 shows variations in blade—blade distances D (represented in a non-dimensional manner with the blade—blade distance at the leading edge being defined as 1) in a direction of a chord in the present embodiment and in the prior art. In the present embodiment, the front throat is at a position of 22%, and the rear throat is at a position of 97%, wherein the inflection point P is located between the position of 80% and the rear throat (the position of 97%).

In FIG. 3, the blade—blade distance D in the prior art is decreased monotonously from the front throat (a position of 5% to 44%) to the rear throat (a position of 93%), whereas the blade—blade distance in the present embodiment is increased monotonously from the front throat (a position of 22%), until it assumes a maximum value at a position of 56%, and is then decreased to the rear throat (the position of 97%). The ratio of the non-dimensional blade—blade distance 1.025 at the maximum value to the non-dimensional blade—blade distance 0.94 at the front throat is about 1.09 and suppressed to lower than 110%.

Figure 6:
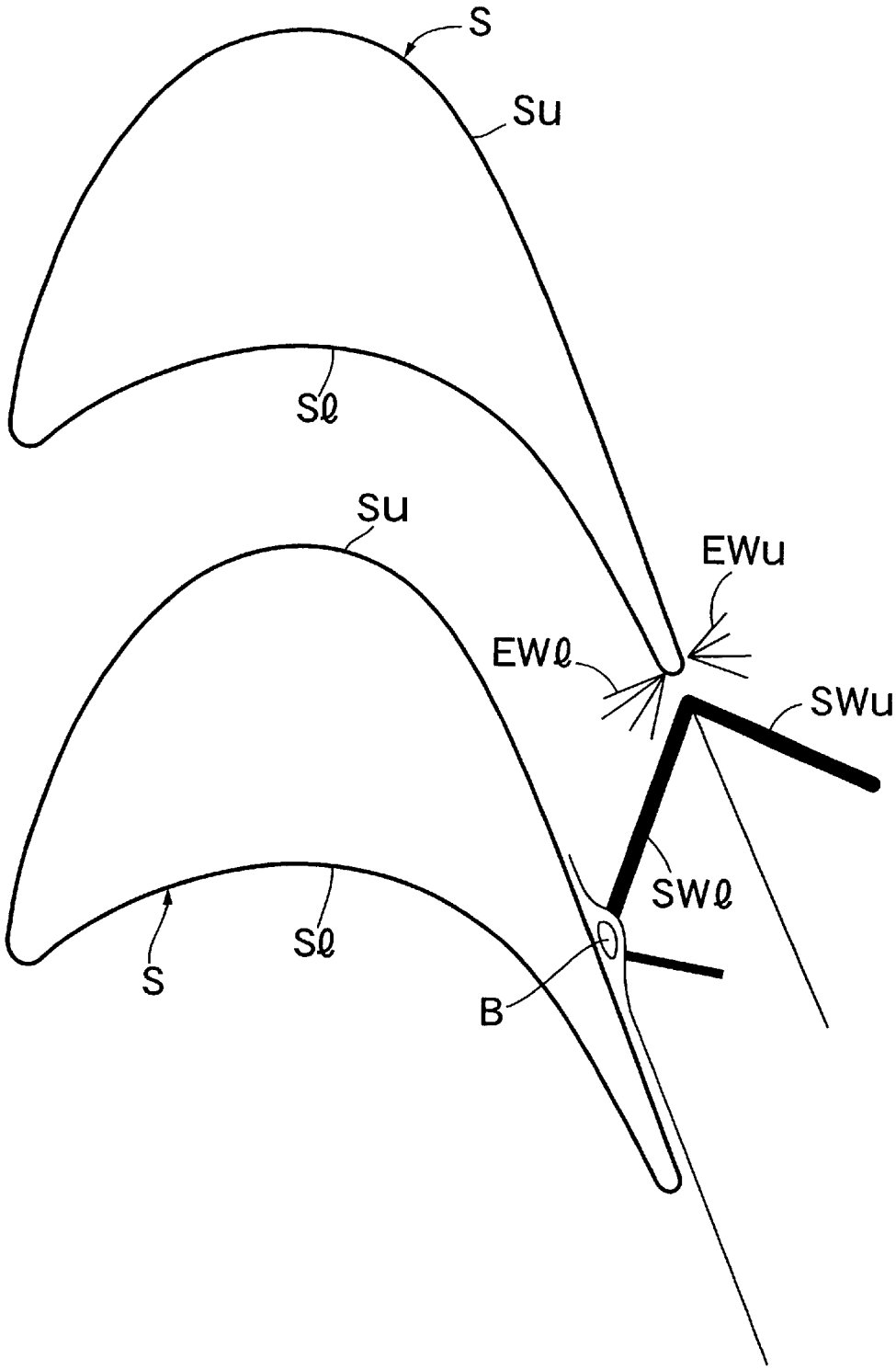
FIG. 6 is a diagram showing the state of a flow around the blade cascade in the prior art.

The blade airfoil S in the present embodiment has the inflection point P between the concave portion on the upstream side and the convex portion on the downstream side in a region of from the position of 80% to the rear throat (the position of 97%) on the intrados Sl. Therefore, the shock wave generated from the intrados Sl in the vicinity of the trailing edge TE can be dispersed into two or more components. FIG. 5 shows the state of a flow of a blade cascade in the present embodiment, where two weak shock waves SW1 and SW2 have been generated, and FIG. 6 shows the state of a flow of a cascade of the blades in the prior art, where a strong shock wave SW1 has been generated. It can be seen that the one shock wave has been generated in the prior art, but the shock wave has been divide into two waves in the present embodiment. In FIGS. 5 and 6, EWu and EW1 denote expanded waves generated by the reduction in speed of the gas on the convex curved face, and B denotes bubbles generated by the stagnation of the gas flow.

By dividing the shock wave on the intrados Sl into two waves in the above manner to weaken the intensity of the individual shock wave, a single shock wave causing a large loss can be prevented from being generated, thereby reducing the pressure loss produced by interference of a shock wave with a boundary layer between the extradoses Su of the adjacent turbine blades S. In addition, the length D of the normal line (namely, the blade—blade distance D) drawn downwards from the intrados Sl of one of the blades in the turbine blade cascade to the extrados Su of the other turbine blade S assumes a maximum value Dmax in a region from the front throat to the rear throat of the one turbine blade S, and if the length D of the normal line at the front throat is defined as a standard, the maximum value Dmax is equal to or smaller than 110% (109%). Therefore, a speed-reducing area is formed on the extrados Su of the turbine blade S due to a reduction in flow speed with an increase in blade—blade distance D, whereby a smooth transition from a laminar flow boundary layer to a turbulent flow boundary layer can be achieved. Thus, it is possible to prevent the seperation of the boundary layer on the extrados Su caused by the interference of the boundary layer with the two shock waves generated from the lower surfaces of the trailing edges TE of the adjacent turbine blades S, thereby further effectively preventing the pressure loss.

If the blade cascade in the present embodiment is employed, the loss factor can be reduced by about 25% at a Mach number M of 1.2 at the outlet of the blade cascade, as compared with a case where the prior art blade cascade is employed, as shown in FIG. 4.

Although the embodiment of the present invention has been described in detail, it will be understood that various modifications may be made without departing from the subject matter of the present invention.

For example, the turbine blade S according to the present invention is applicable to any of stator blade and a rotor blade.

The blade airfoil according to the present invention may be employed over the entire region of the turbine blade S in a span direction or only in a partial region of the turbine blade S in the span direction. Specifically, the blade airfoil according to the present invention (for example, the blade airfoil shown by the solid line in FIG. 1) may be employed in a partial region of the turbine blade S in the span direction, and another turbine airfoil (for example, the blade airfoil shown by the broken line in FIG. 1) may be employed in a remaining region. Thus, the turbine blade airfoil according to the present invention and the existing turbine airfoil can be employed in combination as desired, thereby enhancing the degree of freedom of the design of the turbine blade.

As described above, according to the present invention, the inflection point is provided between the concave portion on the upstream side and the convex portion on the downstream side in the region extending from the position of 80% on the intrados to the rear throat. Therefore, it is possible to disperse a shock wave generated from the intrados at the trailing edge to prevent the generation of a strong shock wave, thereby reducing the pressure loss caused by the shock wave.

Also according to the present invention, it is possible to enhance the degree of freedom of the design of the turbine blade by using the turbine airfoil according to the present invention and an existing turbine airfoil in combination as desired.

Further according to the present invention, the length of the normal line drawn downwards from the intrados of one of the pair of adjacent turbine blades to the extrados of the other turbine blade has at least one maximum value in the region extending from the front throat of the one turbine blade to the rear throat. Therefore, a speed-reducing area can be formed on the extrados generating the negative pressure to promote the transition from a laminar flow boundary layer to a turbulent flow boundary layer, thereby preventing the separation of the boundary layer caused by the interference with a shock wave to reduce the pressure loss.

Still further according to the present invention, the maximum value of the length of the normal line drawn downwards from the intrados of the one turbine blade to the extrados of the other turbine blade is equal to or smaller than 110% of the length of the normal line at the front throat. Therefore, a smooth transition from a laminar flow boundary layer to a turbulent flow boundary layer can be achieved.

What is claimed is:

1. A turbine blade airfoil for an axial-flow turbine including an intrados generating a positive pressure, and an extrados generating a negative pressure, said intrados and said extrados being provided between a leading edge and a trailing edge and said intrados and said extrados, in their entirety, are located on a common side relative to an imaginary line connecting the leading and trailing edges, wherein when the position along the intrados is represented by percentage such that the position of said leading edge is represented by 0%, and the position of the trailing edge is represented by 100%, an inflection point is provided on said intrados and between a concave portion on an upstream side and a convex portion on a downstream side in a region extending from a position of 80% on said intrados to a rear throat.

2. A turbine blade for an axial-flow turbine, which turbine blade is obtained by applying the turbine blade airfoil according to claim 1 to at least a portion of the turbine blade in a span direction.

3. A turbine blade cascade comprising an assembly of turbine blades having a turbine blade airfoil for an axial-flow turbine including an intrados generating a positive pressure, and an extrados generating a negative pressure, said intrados and said extrados being provided between a leading edge and a trailing edge, wherein when the position along the intrados is represented by percentage such that the position of said leading edge is represented by 0%, and the position of the trailing edge is represented by 100%, an inflection point is provided between a concave portion on an upstream side and a convex portion on a downstream side in a region extending from a position of 80% on said intrados to a rear throat, wherein the length of a normal line drawn downwards from an intrados of one of a pair of adjacent turbine blades to an extrados of the other turbine blade has at least one maximum value in a region extending from a front throat to a rear throat of said one turbine blade.

4. A turbine blade cascade for an axial-flow turbine according to claim 3, wherein said maximum value is equal to or smaller than 110% of the length of the normal line at the front throat.

* * * * *